US006510576B1

(12) United States Patent
Gruber

(10) Patent No.: US 6,510,576 B1
(45) Date of Patent: Jan. 28, 2003

(54) VESTIBULE CLEANER AND PLAQUE REMOVER

(76) Inventor: Jack Gruber, 54 Old Pond Rd., Great Neck, NY (US) 11023

( * ) Notice: Subject to any disclaimer, the term of this patent is extended or adjusted under 35 U.S.C. 154(b) by 54 days.

(21) Appl. No.: 09/870,504

(22) Filed: Jun. 1, 2001

(51) Int. Cl.[7] ..... A47K 7/04; A46B 9/04

(52) U.S. Cl. ..... 15/104.94; 15/210.1; 15/227

(58) Field of Search ..... 15/104.94, 110, 15/209.1, 210.1, 227, 145.1; 601/139, 141

(56) References Cited

U.S. PATENT DOCUMENTS

| | | | | |
|---|---|---|---|---|
| 877,585 | A | | 1/1908 | Nicolai |
| 1,073,155 | A | * | 9/1913 | Miller |
| 1,347,275 | A | | 7/1920 | Iden |
| 1,371,790 | A | | 3/1921 | Kelly |
| 1,620,990 | A | | 3/1927 | Brothers |
| 1,729,167 | A | | 9/1929 | Knapp |
| 2,092,987 | A | * | 9/1937 | Remington |
| 2,101,363 | A | | 12/1937 | De Rome |
| 2,218,738 | A | | 10/1940 | Boysen |
| 2,719,315 | A | * | 10/1955 | Sheehan |
| 2,985,167 | A | | 5/1961 | Colb |
| 3,010,131 | A | * | 11/1961 | Kisky |
| 3,018,778 | A | | 1/1962 | Brilliant |
| 3,067,446 | A | * | 11/1962 | McGauley |
| 3,332,103 | A | * | 7/1967 | Case |
| 3,934,299 | A | * | 1/1976 | Regester |
| 4,195,625 | A | | 4/1980 | Bukowski et al. |
| 4,205,664 | A | * | 6/1980 | Baccialon |
| 4,323,347 | A | | 4/1982 | Weissman |
| 4,486,109 | A | | 12/1984 | Rosofsky |
| 4,628,564 | A | * | 12/1986 | Youssef |
| 4,638,521 | A | | 1/1987 | Potente et al. |
| 4,679,274 | A | * | 7/1987 | Friedman |
| 4,731,896 | A | | 3/1988 | de LaTour |
| 4,770,195 | A | | 9/1988 | Dore |
| 4,831,676 | A | | 5/1989 | Denmark |
| 5,027,796 | A | | 7/1991 | Linzey |
| 5,158,532 | A | * | 10/1992 | Peng et al. |
| 5,407,358 | A | | 4/1995 | Gruber |
| 5,500,973 | A | | 3/1996 | Phelan |
| 5,875,513 | A | * | 3/1999 | Reinhold |
| 6,126,444 | A | | 10/2000 | Horiguchi |
| 6,336,461 | B1 | * | 1/2002 | Martinez |

FOREIGN PATENT DOCUMENTS

| | | |
|---|---|---|
| GB | 1 592 513 | 10/1977 |

* cited by examiner

*Primary Examiner*—Terrence R. Till
(74) *Attorney, Agent, or Firm*—Pennie & Edmonds LLP

(57) ABSTRACT

An oral cleaning device having two portions, wherein the first portion is to be handled by the user, and the second portion, having a terry cloth sleeve affixed thereto, is inserted into the mouth for cleaning the vestibule and for removing plaque from teeth therein.

20 Claims, 4 Drawing Sheets

VESTIBULE CLEANER AND PLAQUE REMOVER

FIELD OF THE INVENTION

This invention is directed to an oral cleaning device. In particular, the invention is directed to a device for cleaning the vestibule of the mouth and for removing plaque from teeth. The device has a terry cloth sleeve that is removable and disposable.

BACKGROUND OF THE INVENTION

The significance of oral hygiene in the maintenance of healthy teeth and gums is well recognized. It is well known that dental plaque is the major cause of periodontal disease. Broadly, plaque consists of an adhesive mass of bacteria, mucins, food and other organic matter which, if present for long enough on the teeth, calcifies to form calculus. Consequently, it is appreciated that the effective and complete removal of plaque is essential to the maintenance of good oral hygiene.

The removal of plaque from the oral tissues at an early stage of its development may be achieved by brushing. However, if calcification occurs, then the resultant calculus may only be removed by vigorous mechanical action, usually performed by a dentist. It is therefore important to ensure plaque removal before calcification occurs.

Devices have been developed for clearing the food particles and bacteria from the mouth and teeth. The most well-known and commonly used devices are toothbrushes with bristles that are moved across the teeth to remove food residue and plaque from the enamel surface, as well as larger food particles trapped in between teeth. Toothpicks and dental floss are also frequently used to extract smaller food particles that become trapped between teeth.

U.S. Pat. No. 6,126,444 of Horiguchi discloses a plaque remover consisting of an abradant for removing dental plaque, dirt adhered to teeth, filler, prosthetics, or implants by injecting the device with water or with a combination of water and compressed air. U.S. Pat. No. 5,500,973 of Phelan is also directed to a plaque removing device, adaptable to a water supply, which includes a flexible conduit, an interchangeable toothbrush, a plurality of bristles, and a rinse reservoir.

Conventional brushing of the teeth does not effectively stimulate the gingiva tissue in the thicker gum regions. To adequately stimulate the gums with negligible damage to the tissue area, however, a softer device suited to cleaning the tissue area was needed. A massaging tool, having a half-cylindrical shaped head or mouthpiece, including sturdy, relatively short, closely packed nodules, is disclosed in U.S. Pat. No. 5,027,796 of Linzey. The head of the massaging tool is attached to a handle, providing gently stimulating action. U.S. Pat. No. 4,195,625 of Bukowski discloses a hand-held implement with a specially contoured, flexible tip covered by a strong, absorbent fabric that is removably secured in place. The fabric permits cleansing of the gums of denture wearers on a safe and sanitary basis. The hand-held implement is particularly useful to those persons wearing dentures, having extractions or oral surgery, and having oral infections when the mouth and gums are in a sensitive state.

In addition to cleaning the teeth and gums, the folds of the mouth between the gums and cheeks, known as vestibule of the mouth, also require frequent cleaning. Food particles and plaque, which can collect in the vestibule and further tooth decay and gum disease, need to be removed. Toothbrushes are typically too abrasive for the sensitive tissue in the vestibule and can, therefore, cause pain to the user. In addition, brushes are awkward and difficult to manipulate in the narrow folds between the gums and cheeks. Toothpick-type devices are not well suited to clean the vestibule of the mouth as they do not have enough surface area to clean the folds of the mouth in an effective manner. In addition, the pointed tips on the toothpicks can injure the gums and surrounding tissues. Fingers may also be used to clean the vestibule, however, depending upon the individual, the fingers may be ill-sized to access all areas of the vestibule. Further, germs and bacteria residing on the fingers or underneath fingernails can be spread to the mouth.

U.S. Pat. No. 5,407,358 of the applicant discloses a device for daily cleaning the vestibule of the mouth, not limited to denture wearers, including a rounded tapered end having a bend or curve with respect to the longitudinal axis of the device. The rounded end may be rotatable with respect to a handle portion of the device. The device may be used alone or in combination with a fabric sleeve to sweep matter from the vestibule.

It would be beneficial to provide a device capable of both safely cleaning the vestibule of the mouth and removing plaque. The present invention is directed to a device that accomplishes both.

SUMMARY OF THE INVENTION

The present invention is directed to a device for oral cleaning and plaque removal including an elongated member having a central axis and first and second portions, wherein the second portion has a rounded end and a longitudinal axis, and wherein the longitudinal axis of the second portion is positioned at an angle to the central axis, preferably about 30° to 60°, and more preferably about 45°, to conform to the curvature of a mouth. A terry cloth covering is positioned over at least part of the second portion and affixed thereto for plaque removal and collection of particles in a vestibule. In one embodiment, the device has a length of about 4.5 inches to 6 inches.

The elongated member may include wood, rubber, plastic, or a combination thereof. The first and second portions of the elongated member may be made of substantially the same materials or, in another embodiment, different materials. In another embodiment, the first portion of the elongated member has grooves configured and dimensioned for receiving a user's finger pads.

In one embodiment, the terry cloth covering is pretreated with an oral cleaning composition. In another embodiment, the terry cloth covering is treated with an oral cleaning composition after positioning over at least part of the second portion.

In another embodiment, the terry cloth covering is configured and dimensioned as a sleeve to slide over at least part of the second portion and is preferably seamless and disposable. The terry cloth covering may also be a rectangular swatch of material that is positioned on at least part of the second portion and is affixed thereto by a clamping ring that fits into a groove defined at a position along the length of the second portion.

The device may further include a rotation axis positioned between the first and second portions of the elongated member to enable rotation of the rounded end about the central axis.

The present invention is also directed to an oral cleaning device including a first handle portion having a central axis, a second handle portion having a rounded end, wherein the second handle portion has a longitudinal axis that is angled with respect to the central axis, and a rotational axis positioned between the first and second handle portions which enables rotation of the second handle portion with respect to the first handle portion. A terry cloth material fits over at least part of the second portion for removing plaque and cleaning particles from a vestibule of a mouth.

The present invention is also directed to a plaque removing and vestibule cleaning device including a handle, having a first longitudinal axis, and first and second portions, wherein the second portion has a rounded top end, a grooved bottom end, and a second longitudinal axis that is at an angle with respect to the first longitudinal axis. A rotational axis is positioned between the first and second portions to enable circumferential rotation of the second portion with respect to the first portion and a seamless terry cloth material is positioned over the rounded top end and extends past the grooved bottom end of the second portion. A ring positioned over the rounded top end and fitted into the grooved end of the second portion secures the terry cloth material to the device.

In one embodiment, the terry cloth material is pretreated with an oral cleaning composition. In another embodiment, the oral cleaning composition is applied to the terry cloth material after being positioned and secured onto the device.

Yet another aspect of the invention is directed to a method of plaque from teeth and cleaning a vestibule of a mouth. The method includes inserting a device at least partially into the mouth, the device including an elongated member having a central axis, a first portion configured and dimensioned to be grasped by a user, and a second portion having a rounded end and a longitudinal axis. The longitudinal axis of the second portion is positioned at an angle to the central axis to conform to the curvature of the mouth. A terry cloth covering is positioned over at least part of the second portion and affixed thereto. The terry cloth covering is then rubbed against the teeth to remove plaque therefrom and the vestibule of the mouth is massaged with the terry cloth covering remove particles therefrom.

In one embodiment, the method further includes removing the device from the mouth, removing the terry cloth covering from the device, and disposing of the terry cloth covering.

BRIEF DESCRIPTION OF THE DRAWINGS

Further features and advantages of the invention can be ascertained from the following detailed description which is provided in connection with the attached drawings, wherein:

FIG. 2*a* is a perspective view illustrating one embodiment of the invention;

FIG. 2*b* is a perspective view illustrating a second embodiment of the invention;

DETAILED DESCRIPTION OF THE INVENTION

Figure 1:
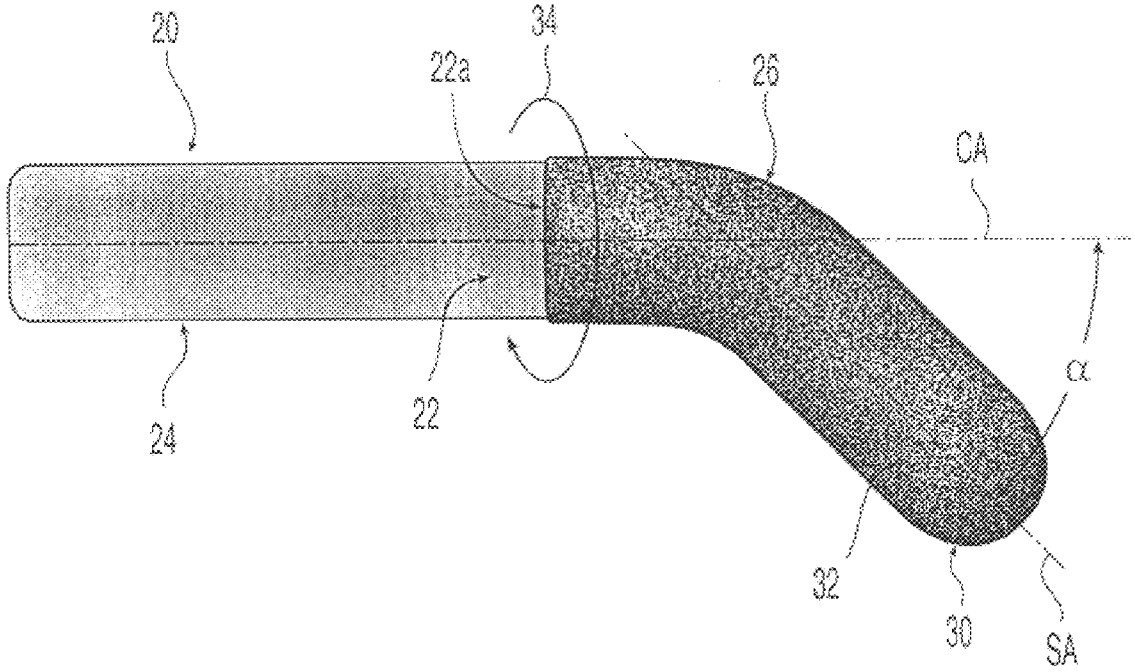
FIG. 1 is a side view illustrating an oral cleaning device according to the invention.

FIG. 1 illustrates an oral cleaning device 20 according to the present invention. The device 20 includes an elongated handle 22 including a first portion 24 and a second portion 26 and having a central, longitudinal axis CA. A first portion 24 of the handle 22 can be formed of any durable material such as plastic, rubber, wood, or other suitable materials, and has a generally flat rounded end configured and dimensioned for manual handling, as shown more clearly in FIG. 2. The first portion 24 can also have finger grooves 24*a*, 24*b*, 24*c*, 24*d* for easier manipulation while handling, illustrated in FIG. 2.

A second portion 26 of the handle 22 includes a curved end 30 that is particularly adapted to clean the vestibule of the mouth, i.e., the fold areas of the mouth between the gums and cheeks, as well as to remove plaque from teeth. The second portion 26 can be formed of any durable material such as plastic, rubber, wood, or the like, and can be substantially the same, or different, material as the first portion 24 of the handle 22.

The end 30 of the second portion 26 is further rounded to remove all sharp edges therefrom. The second portion 26 has a second longitudinal axis SA which forms an angle $\alpha$ with respect to central axis CA of the handle to conform to the natural curvature of the mouth, facilitating access to all areas of the vestibule and teeth during the cleaning process. Angle $\alpha$ is preferably from about 30° to 60°, more preferably about 45°, although the angle is not critical to the invention and may range from 0° to 90°. The second portion 26 is preferably configured to circumferentially rotate with respect to the first portion 24 about the central axis CA as indicated by the arrow 34.

Figure 3:
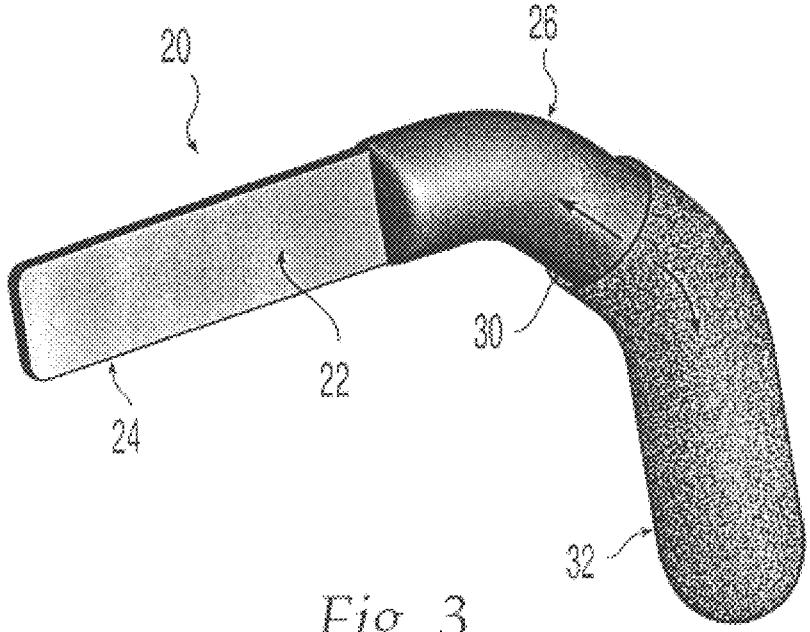
FIG. 3 is a top view illustrating the rotational capability of the second portion of the device according to one embodiment of the invention.
Figure 4:
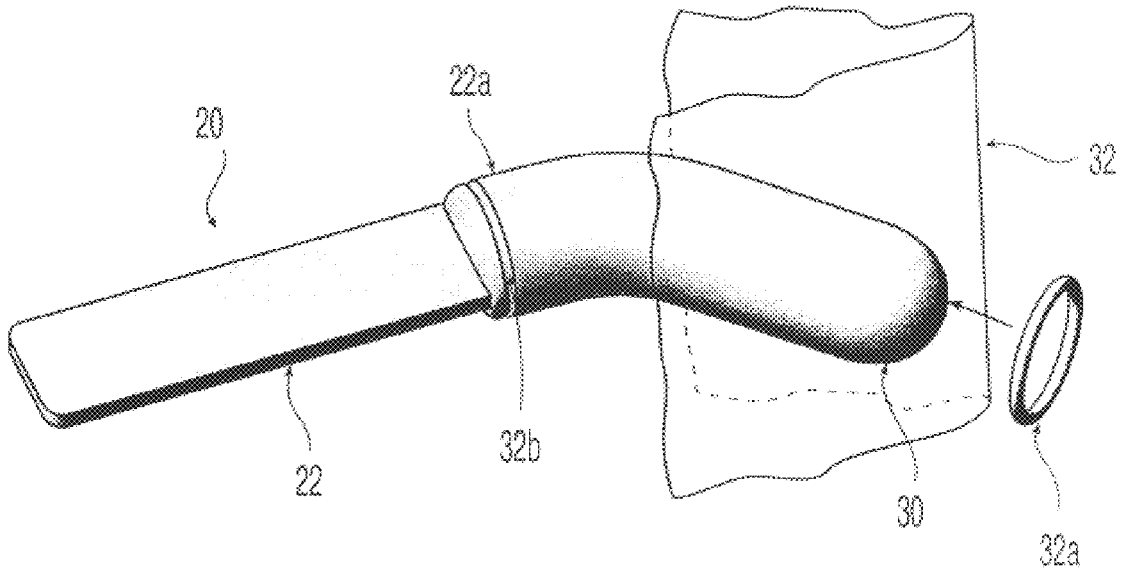
FIG. 4 is an enlarged partial view of the handle illustrating the rotation axis member of FIG. 3.

The second portion 26 is covered with a piece of terry cloth material 32, which collects the food particles and plaque both in the vestibule and on the teeth during cleaning. In one embodiment, as shown in FIG. 3, the terry cloth material 32 may be configured as a sleeve to slip over the rounded end 30, and is attached to the handle 22, preferably secured to the device with a suitable adhesive or clamping instrument. The sleeve is preferably seamless to lessen potential damage to soft tissue areas in the vestibule. The terry cloth is preferably disposable and may be replaced as needed. In another embodiment, shown in FIG. 4 the terry cloth material 32 may be a square that is wrapped around the rounded end 30 and secured to the second portion 26 of the handle 22 by a ring 32*a* that slips over the rounded end and fits snugly into a groove 32*b* at the bottom end 22*a* of the second portion 26 of the handle 22.

The terry cloth material 32 may be made of natural or synthetic fibers, or a combination thereof, and may be woven with the absorbent loops on one side or both sides. The warp threads of the material should have a minimum stretch of one-third inch per inch of terry cloth material. The material should be color fast and not subject to rapid discoloration when used with oral cleaning compositions, e.g., toothpastes and mouthwash.

The terry cloth material allows for improved plaque and bacteria removal due to the relative roughness of the fabric. The weave of the terry cloth material results in significantly protruding loops that are able to adhere and retain plaque and other bacteria in the mouth more effectively than materials with finer constructions, e.g., gauze.

In one embodiment, the terry cloth material is pretreated with an oral cleaning composition that when in contact with water, acts to produce a paste-like substance to aid in removing plaque and bacteria from the surface of the tooth enamel. This would typically be done in a manufacturing setting and the user may then buy the pretreated terry cloth material. The oral cleaning composition may also be flavored, e.g., bubble gum flavor, cherry flavor, peanut butter flavor, etc., to be more palatable for use with children or animals.

Figure 5:
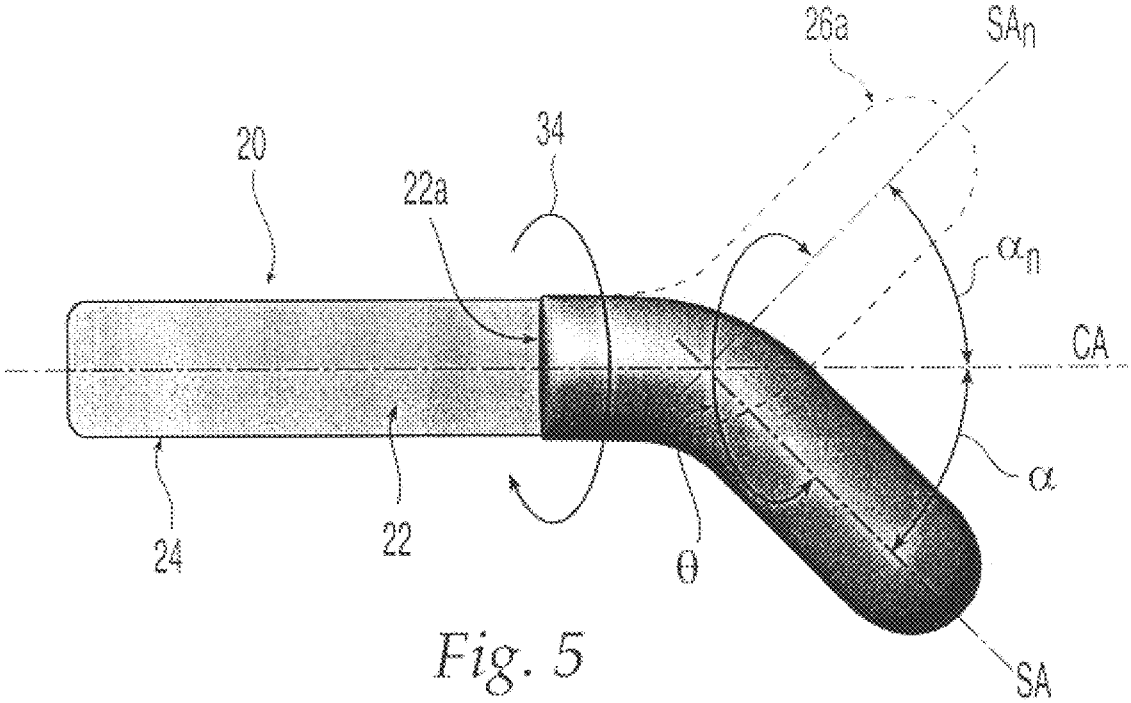
Figure 6:
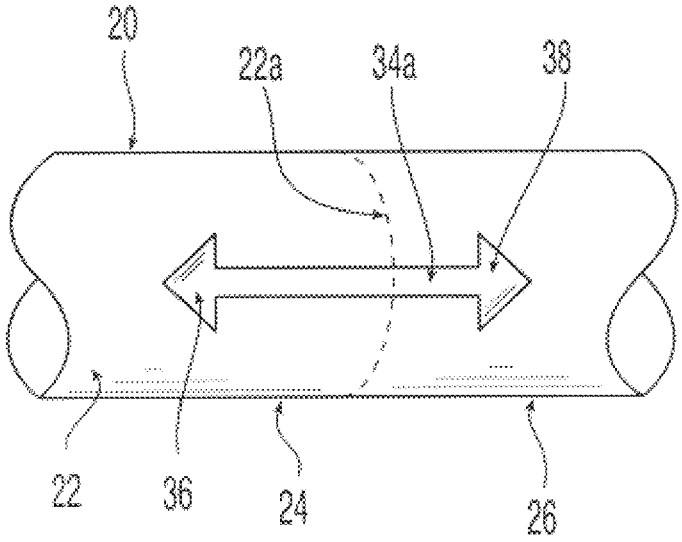

FIG. 5 shows the potential rotational capability of the device, wherein the second portion 26 has a second longitudinal axis SA which forms an angle $\alpha$ with respect to central axis CA of the handle. The handle 22 is segmented along line 22*a*. In this embodiment, the device 20 includes a rotation axis member 34*a* having flexible ends 36, 38 which fit within corresponding apertures in the first and second portions 22, 26 of the handle 22, as shown in FIG. 6. The rotation axis member 34*a* is preferably formed of a flexible material, such as rubber so that, in addition to providing circumferential rotation, the axis further permits the second portion 26 of the handle 22 to flex slightly during use. The circumferential motion is demonstrated in FIG. 5 wherein the second portion 26*a* is rotated from the original position by $\theta$, resulting in a second longitudinal axis $SA_n$ with angle $\alpha_n$ which is equal to $\alpha+\theta$.

In one embodiment, the first portion 24 and the second portion 26 are not made of the same material. For example, in the embodiment illustrated in FIGS. 1 and 2, the first portion of device may be formed of plastic, while the second portion may be formed of rubber. In another embodiment, the first portion 24 and the second portion 26 are made of similar materials, e.g., the first and second portions include rubber.

The device can be manufactured for different types of settings. For use in a professional setting, i.e., a dental office, the device may be formed of rubber and sterilized in an autoclave prior to use, minimizing the transmission of germs. The sleeves are preferably disposable. The device may also be formed of inexpensive wood, rubber, plastic, or other suitable materials, and packaged individually, with disposable terry cloth sleeves, to function as a daily oral cleaning device, i.e., as one uses a toothbrush.

Figure 2:
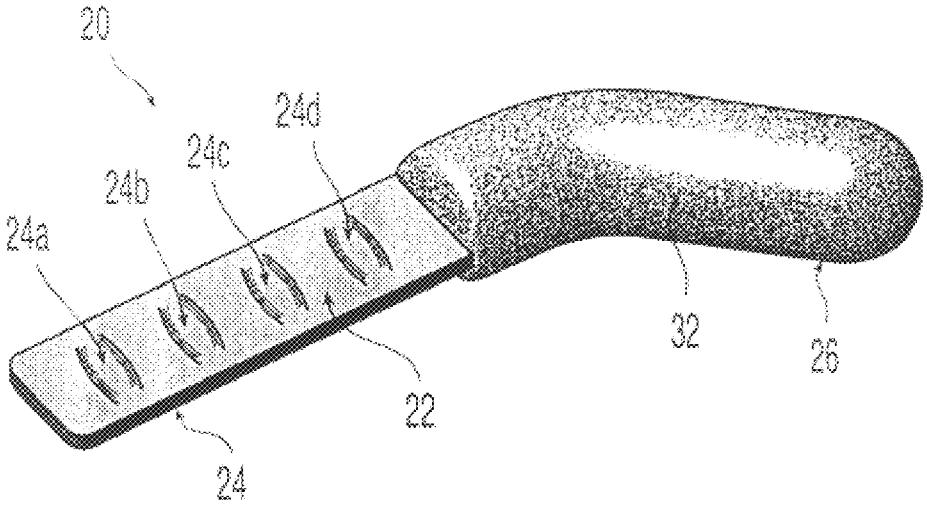
FIG. 2 is a perspective view illustrating an oral cleaning device according to the invention.

As those skilled in the art will recognize, the dimensions of the handle and ends thereof can be varied as desired. The first portion of the handle can have a width of about 0.13 inches to 0.75 inches, although this is not critical to the invention. In one embodiment, the width of the handle is about 0.5 inches. The first portion of the handle may be flattened, with the thickness from about 0.06 inches to 0.4 inches. In one embodiment, the thickness of the first portion is preferably about 0.25 inches. Preferably, the width of the second portion 26 is from about 0.13 inches to 0.75 inches. In a more preferred embodiment, the second portion is about 0.5 inches in width. The height of the second portion is preferably from about 0.13 inches to 0.75 inches, and more preferably about 0.25 inches. When configured as illustrated in FIGS. 1 and 2, a preferred device length has been found to be from about 4.5 inches to 6 inches, more preferably about 5 inches. The term "about," as used herein in connection with one or more numbers or numerical ranges, should be understood to refer to all such numbers, including all numbers in a range. It should be noted that other sizes may also be useful, depending upon the application. For instance, the device may be useful in cleaning animal teeth. If this is the case, the size of the device may vary based upon the size of the animal's mouth.

To use the device, a user grasps the first portion 24 of the handle 22 and covers the second portion 26 with the terry cloth material 32, preferably secured in some fashion, inserts the rounded end 30 of the second portion 26 into the mouth. The flatness of the first portion 24 enables the device to be comfortably held within the hand during the cleaning process. The terry cloth material, if not pre-treated with a oral cleaning composition, can be coated with any known oral cleaning substance. If the terry cloth material is pre-treated, the sleeve should be wet after securing on the device. The terry cloth sleeve can also be used without any application of an oral cleaning substance. The user moves the rounded end 30 in the mouth and contacts the surface of the teeth, using a gentle circular motion to remove plaque therefrom. The user then moves the rounded end 30 in and around the vestibule of the mouth, sweeping away food particles and other bacteria, leaving the vestibule free of debris. The rotation of the second portion 26 of the handle with respect to the first portion 24 and the curvature of the second portion enable facilitated access to all areas of the vestibule. The rounded edges of the second portion 26 further provide a smooth contact surface that prevents abrasion of tissues during the cleaning process.

It is to be understood that the invention is not to be limited to the exact configuration as illustrated and described herein. For example, the device of the invention may be implemented in various designs using a handle of two portions, wherein the end to be used for cleaning one at an angle to the longitudinal axis of the device, preferably rotatable, with a terry cloth sleeve. The embodiments discussed in the Detailed Description of the Invention are not intended to limit the invention. Accordingly, all expedient modifications readily attainable by one of ordinary skill in the art from the disclosure set forth herein, or by routine experimentation therefrom, are deemed to be within the spirit and scope of the invention as defined by the appended claims.

What is claimed is:

1. A plaque removing and vestibule cleaning device comprising:

a handle, having a first longitudinal axis, comprising a first portion and a second portion, wherein the second portion has a rounded top end, a grooved bottom end, and a second longitudinal axis that is at an angle with respect to the first longitudinal axis;

a rotational axis positioned between the first and second portions to enable circumferential rotation of the second portion with respect to the first portion;

a seamless terry cloth material positioned over the rounded top end and extending past the grooved bottom end of the second portion; and a ring positioned over the rounded top end and fitting into the grooved end of the second portion to secure the terry cloth material to the device.

2. The device of claim 1, wherein the terry cloth material is pretreated with an oral cleaning composition.

3. The device of claim 1, wherein an oral cleaning composition is applied to the terry cloth material after being positioned and secured onto the device.

4. An oral cleaning device comprising:

a handle comprising:

a first portion; and a second portion having a top end and a bottom end, the second portion being angled with respect to the first portion and further being rotatable relative to the first portion;

a terry cloth material positioned over the top end of the second portion; and a clamping instrument securing the terry cloth material to the handle.

5. The oral cleaning device according to claim 4, wherein the clamping instrument is a ring.

6. The oral cleaning device according to claim 5, wherein the bottom end of the second portion is provided with a groove, and the ring cooperates with the groove to secure the terry cloth material to the handle.

7. The oral cleaning device according to claim 6, wherein the terry cloth material is wrapped around the top end of the second portion.

8. The oral cleaning device according to claim 6, wherein the terry cloth material is configured as a sleeve slipped over the top end of the second portion.

9. The oral cleaning device according to claim 8, wherein the sleeve is seamless.

10. The oral cleaning device according to claim 4, wherein the second portion is provided with a groove at the bottom end, the clamping instrument securing the terry cloth material at the groove.

11. The oral cleaning device according to claim 4, wherein the terry cloth material is pretreated with an oral cleaning composition.

12. The oral cleaning device according to claim 4, wherein the terry cloth material is wrapped around the top end of the second portion.

13. The oral cleaning device according to claim 4, wherein the terry cloth material is configured as a sleeve slipped over the top end of the second portion.

14. The oral cleaning device according to claim 13, wherein the sleeve is seamless.

15. An oral cleaning device comprising:

a handle comprising:

a first portion; and a second portion having a top end and a bottom end, the second portion being angled with respect to the first portion and further being rotatable relative to the first portion, the second portion further being provided with a groove; and a terry cloth material positioned over the top end of the second portion and enters to said groove.

16. The oral cleaning device according to claim 15, wherein the groove is formed at the bottom end of the second portion.

17. The oral cleaning device according to claim 15, wherein the terry cloth material is secured by a ring that fits into the groove.

18. The oral cleaning device according to claim 15, wherein the terry cloth material is wrapped around the top end of the second portion.

19. The oral cleaning device according to claim 15, wherein the terry cloth material is configured as a sleeve slipped over the top end of the second portion.

20. The oral cleaning device according to claim 15, wherein the terry cloth material is pretreated with an oral cleaning composition.

* * * * *